US006281398B1

(12) United States Patent
Belloir et al.

(10) Patent No.: US 6,281,398 B1
(45) Date of Patent: Aug. 28, 2001

(54) PROCESS FOR THE PRODUCTION OF HIGH OCTANE NUMBER GASOLINES

(75) Inventors: Pierre Belloir, Braine Le Comte; Eric Romers, Limelette; Christian Lamotte, Arquennes; Jacques Grootjans, Leefdaal, all of (BE)

(73) Assignee: Fina Research, S.A., Feluy (BE)

( * ) Notice: Subject to any disclaimer, the term of this patent is extended or adjusted under 35 U.S.C. 154(b) by 0 days.

(21) Appl. No.: 09/429,678

(22) Filed: Oct. 28, 1999

Related U.S. Application Data

(63) Continuation of application No. 08/187,563, filed on Jan. 27, 1994, now abandoned.

(30) Foreign Application Priority Data

Feb. 2, 1993 (BE) ..... 09300104

(51) Int. Cl.[7] ..... C10G 63/02; C10G 35/04

(52) U.S. Cl. ..... 585/322; 585/323; 585/413; 585/475; 208/64

(58) Field of Search ..... 585/319, 322, 585/323, 413, 419, 475; 208/64

(56) References Cited

U.S. PATENT DOCUMENTS 4,211,886 * 7/1980 Tabak et al. ..... 585/321

FOREIGN PATENT DOCUMENTS 8912613 5/1989 (WO) ..... C07C/6/12

* cited by examiner

*Primary Examiner*—Bekir L. Yildirim
(74) *Attorney, Agent, or Firm*—Jim D. Wheelington

(57) ABSTRACT

A process is disclosed for improving the yield in the production of high octane gasoline after naphtha reforming by utilizing a transalkylation step to upgrade the heavy and light fractions coming from the reforming step.

8 Claims, 1 Drawing Sheet

PROCESS FOR THE PRODUCTION OF HIGH OCTANE NUMBER GASOLINES

CROSS-REFERENCE TO RELATED APPLICATION

This application is a continuation of a application, Ser. No. 08/187,563, filed Jan. 27, 1994, by B. Belloir, et al., under the same title now abandoned.

BACKGROUND OF THE INVENTION

The present invention relates to a process for improving the yield of high octane number gasolines. More specifically, the present invention relates to a process for increasing the yield of high octane gasolines produced during the naphtha reforming step.

Naphtha reforming is a well known process used to improve gasoline quality. The naphtha fraction has a boiling temperature between 80 and 200° C. and essentially contains paraffins, naphthenes and aromatics. The most important reaction occurring during naphtha reforming consists in the dehydrocyclization of the paraffins into aromatics. It is well known that catalytic reforming tends to increase the final boiling point of the reformate (compared to the naphtha) and to favor benzene formation. Moreover these phenomena are more marked since low pressures (about 1MPa or less) and high temperatures are often used. However, among the requirements regarding reformulated gasolines, it is known that the final boiling point of the reformate must be sufficiently low and the benzene content limited.

It has now been discovered that it is possible to significantly improve the high octane gasoline yield and to solve the above-identified problems.

The object of the present invention is to provide a process which increases the high octane gasoline yield, i.e. the intermediate fraction coming from the naphtha reforming step.

SUMMARY OF THE INVENTION

The process of the present invention for increasing the intermediate fraction comprises the steps of:

a. submitting a naphtha feed to a catalytic reformer and contacting said feed with a catalytic reforming catalyst in order to form light, intermediate and heavy fractions;

b. separating said three fractions in a separator and recovering the intermediate fraction.

c. mixing at least a part of the light fraction from said separator with at least a part of the heavy fraction to form a mixture.

d. subjecting said mixture to a transalkylation system to form a second mixture having a new intermediate fraction; and e. recycling the effluent coming from said transalkylation system into said separator and recovering additional intermediate fractions.

BRIEF DESCRIPTION OF THE DRAWING

The present invention is also described in FIG. 1 which represents a schematic diagram of the process of the invention.

DESCRIPTION OF THE PREFERRED EMBODIMENTS

Figure 1:
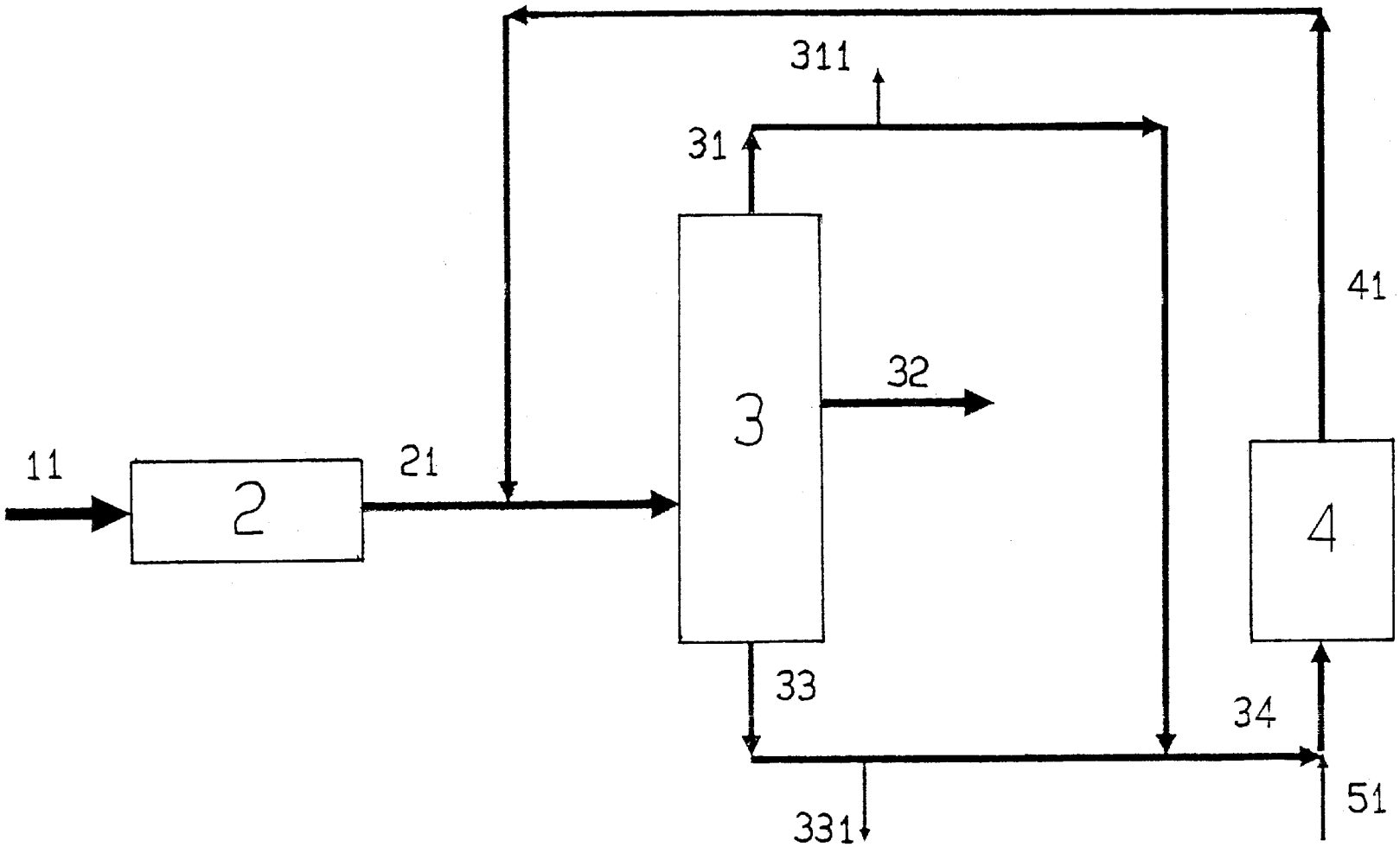

Referring to FIG. 1, a naphtha feed is introduced via feed conduit 11 into a reformer 2 and contacted with a suitable reforming catalyst under conventional reforming conditions. The effluent recovered from the reforming step flows via conduit 21 into a separator 3 where it is separated into three fractions: a light fraction 31, rich in benzene and having a boiling point lower than about 90° C.; an intermediate fraction 32 having a boiling point between about 90 and 180° C.; and a heavy fraction 33 having a boiling point higher than about 180° C.

The heavy and light fractions are then mixed in a tansalkylation reactor 4 wherein the fractions are contacted with a conventional transallylation catalyst under suitable transalkylation conditions. This transallylation step may be performed in an upward or downward flow reactor vessell. The effluent coming from this transalkylation step is via flow conduit 41 to conduit 21 where it is mixed with the effluent coming from the catalytic reformer 2. The mixed effluent and reformer output is then transmitted to the separator where a more desirable intermediate fraction is recovered.

While it is not essential to the smooth running of the process of the present invention, hydrogen may be added through hydrogen supply conduit 51 prior to the transalkylation step in reactor 4, which generally improves catalyst activity and reduces coking in the reactor.

Conduits 311 and 331, while not essential to the present process, allow an adjustment to be made to the respective proportions of the heavy and light fractions being introduced into the transalkylation reactor.

One skilled in the art of catalytic reforming of hydrocarbons will realize that the goal of catalytic reforming is the selective conversion of saturated hydrocarbons into aromatics. With the present process, it is possible to optimize outputs of high octane gasolines as well as aromatic hydrocarbons.

Many reactions occur during the catalytic reforming, with dehydrogenation being the principle one. The catalysts generally used have two characteristics: a metallic element promotes catalysis of the dehydrogenation/hydrogenation reaction; and an acid function catalyzes the hydrocarbon rearrangement. These catalysts usually contain a small amount of highly dispersed platinum (preferably less than 1% by weight) supported on a high specific area alumina (about 150–300 m2/g) with a second metal such as rhenium also being added. These catalysts are dispersed on a basic support medium. The operating conditions usually include a temperature of between 400 and 550° C. and a pressure between 0.3 and 3.5 MPa. Generally, the reaction is performed in either fixed or moving bed reactors.

It was unexpectedly discovered that the total amount of the intermediate fraction, i.e. the yield in high octane gasoline, could be increased by submitting a mixture of heavy and light fractions to a transalkylation step and by reintroducing the resulting effluent into the separation step.

Although it is not necessary for carrying out the process of the present invention, any other source of diluted benzene and/or any other source of polyalkylbenzene can also be utilized in the light fraction/heavy fraction mixing step.

According to the present invention, any conventional known transalkylation process of polyalkylbenzene into monoalkylbenzene can be used. Such conventional processes include those wherein a feed comprising benzene and polyalkylbenzenes is reacted in a transalkylation reactor, in the presence of a catalyst, to form monoalkylbenzenes. According to the present invention a process similar to the one disclosed is the International patent application WO89/12613 in the name of Lummus Crest Inc., which is herein incorporated by reference, is preferably used. This patent discloses a transalkylation process wherein a feedstream containing at least one polyalkylbenzene is introduced into a reactor in the presence of a transalkylation catalyst in order to produce at least one monoalkylbenzene. The reaction is carried out in the presence of hydrogen. The hydrogen-to-alkyl group molar ratios are preferably in the range of 1:10 and 1:1.

According to the present invention several kinds of transalkylation catalysts may be used, including molecular sieve catalysts which are doped with metallic hydrogenation compounds based on group VIII metals of the periodic table of elements such as nickel, palladium and platinum. Particularly advantageous are large-pore molecular sieve catalysts, and preferably those with a constraint index of less than about 1; as constraint index is defined in U.S. Pat. No. 4,211,886, col. 5. Mordenite type catalysts are preferably used, particularly mordenite type catalysts slightly deficient in aluminum and having silica/alumina molar ratios up to about 30, and preferably up to about 20. Among the useful mordenite type catalysts are those described in U.S. Pat. Nos. 4,665,258 and 4,723,048.

One of the advantages of the present invention is the upgrading of the heavy fraction coming from the reforming step.

Another advantage of the present invention is that it allows one to process naphtha feeds without any needed treatment prior to reforming. In conventional naphtha reforming processes, in order to minimize the amount of heavy fraction produced during reforming, it is preferable to treat the starting naphtha feed by removing the high boiling point compounds. Utilizing the present invention eliminates this naphtha pretreatment step which is a significant advantage over conventional processes.

After the reforming step, the obtained light fraction is rich in benzene. In conventional processes this light fraction was then incorporated into gasoline which required additional treatment in order to limit the gasoline benzene content. This further step is no longer necessary when utilizing the process of the present invention since the benzene content is automatically limited as a result of the benzene conversion during the transalkylation step.

The following examples are given in order to better illustrate the present invention, but in no way to limit its scope.

EXAMPLE

A naphtha feed is subjected to a catalytic reforming step (the respective compositions of the feed and of the effluent are indicated in Table 1) and, after having proceeded with separation by distillation of the light, intermediate and heavy fractions, the total amounts of light and heavy fractions are mixed. Hydrogen is added to the mixture and the whole is introduced into a transalkylation reactor.

The catalyst used is nickel (1.6% by weight) deposited on a mordenite having a silica/alumina molar ratio of 8.8:1. This catalyst is activated as follows: under 6 MPa, with a hydrogen flow, the temperature is progressively increased up to 200° C. and maintained for 12 hours. Then the temperature is increased to 360° C. and stabilized for 4 hours. Then the reactor is cooled to 200° C.

The operating conditions of the transalkylation step and the composition of the transalkylation effluent are indicated in the following Table 1. Table 2 then shows the results of five different test run samples at various times during the run using the present process.

TABLE 1

| | FEED (WEIGHT %) | EFFLUENT (WEIGHT %) |
|---|---|---|
| Normal PARAFFINS (no. of carbon atoms) | | |
| 4 | 0 | 0.4 |
| 5 | 0 | 1.4 |
| 6 | 3.9 | 1.9 |
| 7 | 7.5 | 1.0 |
| 8 | 5.4 | 0.2 |
| 9 | 3.4 | 0 |
| 10 | 1.5 | 0 |
| 11 | 0 | 0 |
| total | 21.6 | 5.0 |
| Isomer PARAFFINS | | |
| 4 | 0 | 0.2 |
| 5 | 0 | 0 |
| 6 | 2.0 | 4.5 |
| 7 | 8.2 | 4.1 |
| 8 | 9.5 | 0 |
| 9 | 4.9 | 0 |
| 10 | 2.2 | 0 |
| 11 | 1.0 | 0.1 |
| total | 27.6 | 8.8 |
| NAPHTHENES | | |
| 4 | 0 | 0 |
| 5 | 0 | 2.3 |
| 6 | 6.0 | 0.6 |
| 7 | 11.9 | 0.2 |
| 8 | 10.8 | 0.5 |
| 9 | 7.2 | 0 |
| 10 | 0.9 | 0 |
| 11 | 0 | 0 |
| total | 36.8 | 3.6 |
| AROMATICS | | |
| 6 | 0.9 | 7.6 |
| 7 | 4.2 | 26.3 |
| 8 | 6.4 | 35.6 |
| 9 | 1.9 | 9.8 |
| 10 | 0.5 | 3.1 |
| 11 | 0 | 0.1 |
| total | 14.0 | 82.5 |
| TOTAL | 100 | 100 |

TABLE 2

| | | | | | |
|---|---|---|---|---|---|
| Temperature (° C.) | 331 | 340 | 350 | 360 | 359 |
| $H_2$/polyalkylbenzene (molar ratio) | 4.5 | 4.5 | 4.5 | 4.5 | 9.0 |
| Benzene/polyalkylbenzene (molar ratio) | 1.7 | 1.7 | 1.7 | 1.7 | 1.7 |
| Pressure (MPa) | 6 | 6 | 6 | 6 | 6 |
| Linear speed (l/l/h) | 2 | 2 | 2 | 2 | 1 |
| Time (hours) | 48 | 72 | 96 | 120 | 144 |
| Benzene conversion (molar %) | 26 | 27 | 30 | 38 | 48 |
| Composition (weight %) | | | | | |
| light fraction | 71 | 70.6 | 68.7 | 68.9 | 57.8 |
| intermediate fraction | 14.8 | 17.3 | 20.5 | 21.6 | 36.0 |
| heavy fraction | 14.2 | 12.1 | 10.8 | 9.5 | 6.2 |

Thus, it can be seen from this example and the above Tables 1 and 2 that the effluent from the reformer (column 3) is much richer in aromatics (82.5%) and depleted in paraffins and naphthenes than the original feed material. And Table 2 illustrates that the transalkylation step converts the light fraction rich effluent (71% at 48 hours) and heavy fraction effluent (14.2% at 48 hours) into a final effluent rich in intermediate fractions at 144 hours (36.0% vs. 14.8%). The result is a two-fold increase in the more desirable intermediate fraction.

Although a specific preferred embodiment of the present invention has been described in the detailed description above, the description is not intended to limit the invention to the particular forms or embodiments disclosed therein since they are to be recognized as illustrative rather than restrictive and it will be obvious to those skilled in the art that the invention is not so limited. Thus, the invention is declared to cover all changes and modifications of the specific example of the invention herein disclosed for purposes of illustration which do not constitute departure from the spirit and scope of the invention.

What is claimed is:

1. A process for increasing the yield in high octane gasoline consisting of the steps of:

(a) submitting a naptha feed to catalytic reforming in a catalytic reformer by contacting said feed with a catalytic reforming catalyst in order to form a reformed effluent consisting of light, intermediate and heavy fractions, the light fraction being rich in benzene;

(b) separating said three factions in a separator into which the reformed effluent is directly introduced from the catalytic reformer, and recovering the intermediate fraction;

(c) mixing the total amount of the light fraction rich in benzene from said separator with the total amount of the heavy fraction to form a mixture;

(d) subjecting said mixture to a transalkylation system to form a second mixture having an increased intermediate fraction; and, (e) recycling the effluent coming from said transalkylation system into said separator and recovering additional intermediate fractions.

2. The process of claim 1 characterized in that the transalkylation step is performed in the presence of hydrogen.

3. The process of claim 2 characterized in that an outside source of benzene is added at step c.

4. The process of claim 3, wherein an outside source of polyalkylbenzene is added at step c.

5. The process of any of the preceding claims characterized in that the transalkylation step is performed in the presence of a transalkylation catalyst selected from molecular sieves with large pores having a constraint index lower than about 1.

6. The process of claim 4, wherein the transalkylation catalyst is a mordenite.

7. The process of claim 6, wherein the mordenite has a silica/alumni molar ratio of up to 30.

8. The process of claim 7, wherein the mordenite has a silica/alumni ratio of up to about 20.

* * * * *